US007408515B2

(12) United States Patent
Leisten

(10) Patent No.: US 7,408,515 B2
(45) Date of Patent: Aug. 5, 2008

(54) MOBILE COMMUNICATION DEVICE AND AN ANTENNA ASSEMBLY FOR THE DEVICE

(75) Inventor: Oliver Paul Leisten, Northampton (GB)

(73) Assignee: Sarantel Limited, Wellingborough (GB)

( * ) Notice: Subject to any disclaimer, the term of this patent is extended or adjusted under 35 U.S.C. 154(b) by 108 days.

(21) Appl. No.: 11/263,643

(22) Filed: Oct. 31, 2005

(65) Prior Publication Data

US 2007/0063902 A1 Mar. 22, 2007

(30) Foreign Application Priority Data

Sep. 22, 2005 (GB) ..... 0519371.9

(51) Int. Cl.
*H01Q 1/24* (2006.01)

(52) U.S. Cl. ..... 343/702; 343/895

(58) Field of Classification Search ..... 343/700 MS, 343/702, 846, 895

See application file for complete search history.

(56) References Cited

U.S. PATENT DOCUMENTS

| | | | | |
|---|---|---|---|---|
| 4,008,479 | A * | 2/1977 | Smith | 343/895 |
| 5,650,792 | A | 7/1997 | Moore et al. | |
| 5,784,034 | A * | 7/1998 | Konishi et al. | 343/895 |
| 5,910,790 | A * | 6/1999 | Ohmuro et al. | 343/895 |
| 5,945,963 | A * | 8/1999 | Leisten | 343/895 |
| 6,222,505 | B1 * | 4/2001 | Endo et al. | 343/895 |
| 6,600,450 | B1 | 7/2003 | Efanov et al. | |
| 2002/0123312 | A1 | 9/2002 | Hayes et al. | |
| 2002/0180649 | A1 | 12/2002 | Iguchi et al. | |

FOREIGN PATENT DOCUMENTS

| | | |
|---|---|---|
| EP | 0957533 | 11/1999 |
| EP | 11182727 | 8/2003 |
| EP | 1505689 | 2/2005 |
| GB | 2292638 | 2/1996 |
| GB | 2410837 | 8/2005 |
| JP | 2224506 | 9/1990 |

OTHER PUBLICATIONS

A. Wingfield, O.P. Leisten, "12th Int. Conf. on Antennas and Propagation", published 2003, Fol. 1, pp. 39-42, "Performance Evaluation of Small Antennas for Global Positioning System (GPS)".

International search report from PCT/GB2006/003318, Nov. 15, 2006.

* cited by examiner

*Primary Examiner*—Tho G Phan
(74) *Attorney, Agent, or Firm*—John Bruckner PC

(57) ABSTRACT

A mobile communication device has an antenna assembly comprising the combination of an inverted-F antenna and a dielectrically-loaded quadrifilar helical antenna, the latter mounted on the distal end of an elongate radiator element of the inverted-F antenna. The dielectrically-loaded antenna has an integral balun on a ceramic antenna core, the balun providing a balanced feed for the radiating elements of the antenna The elongate radiator structure of the inverted-F antenna acts as a feed path for the dielectrically-loaded antenna, the feed path extending along the elongate radiator structure from the balun to a ground connection element of the inverted-F antenna and, thence, to a signal port associated with a grounding connection of the inverted-F antenna Placing the dielectrically-loaded quadrifilar antenna at the end of the radiator structure of the inverted-F antenna rather than alongside the latter substantially reduces breakthrough from a transmitter coupled to the inverted-F antenna to receiving circuitry coupled to the dielectrically-loaded antenna.

28 Claims, 6 Drawing Sheets

MOBILE COMMUNICATION DEVICE AND AN ANTENNA ASSEMBLY FOR THE DEVICE

CROSS-REFERENCE TO RELATED APPLICATION

This application is related to, and claims a benefit of priority under one or more of 35 U.S.C. 119(a)-119(d) from copending foreign patent application 0519371.9, filed in the United Kingdom on Sep. 22, 2005 under the Paris Convention, the entire contents of which are hereby expressly incorporated herein by reference for all purposes.

FIELD OF THE INVENTION

This invention relates to a mobile communication device comprising radio frequency (RF) circuitry and an antenna assembly coupled to the circuitry.

BACKGROUND OF THE INVENTION

The assignee of the present applicant is the registered proprietor of a number of patents and patent applications which disclose dielectrically-loaded antennas for operation at frequencies in excess of 200 MHz. Examples of such patents are GB2292638B, GB2310543B and GB2367429B. In each case, the antenna comprises an electrically insulative antenna core of a solid material having a relative dielectric constant greater than 5, a three-dimensional antenna element structure disposed on or adjacent the outer surface of the core and defining an interior volume, and a feeder structure which is connected to the element structure and passes through the core. Typically, the antenna element structure comprises conductive helical elements on a ceramic cylindrical core, the elements being arranged in pairs, each pair comprising diametrically opposed helical tracks plated on the cylindrical surface of the core. Each helical element extends from a radial connection to the feeder structure on a distal end surface of the core to a conductive sleeve which is connected to a shield conductor of the feed structure at a proximal end surface of the core, the sleeve thereby forming a balun so that, at an operating frequency of the antenna, the helical elements are provided with a substantially balanced feed point at the distal end surface.

Such an antenna, when provided with four helical co-extensive circumferentially spaced elements or groups of elements, has a mode of resonance which renders it especially suitable for receiving signals transmitted by earth-orbiting satellites, the signals being transmitted as circularly polarised waves. A particular use of such antennas, therefore, is for receiving signals transmitted by the Global Positioning System (GPS) satellite constellation.

The entire disclosure of the above-mentioned patents is incorporated in the present specification by reference.

There is a need for handheld mobile communication devices, such as mobile telephones or cellphones using terrestrial signals, also to receive signals from satellite systems such as the GPS constellation. Commonly, such mobile communication devices have a planar inverted-F antenna (PIFA) for transmitting and receiving terrestrial signals. A PIFA is a single-ended antenna in that it requires a conductive body to act as a ground plane for reflecting wave energy present on a radiator structure of the antenna so as to produce a standing wave. PIFA antennas may have at least one resonating finger which, at its base, is typically connected to a feed connection element connecting the radiator structure represented by the finger to a signal port of associated RF transmitting and receiving circuitry, and by a shunt element to a ground connection which is spaced apart from the signal port. The bandwidth of the antenna is determined, inter alia, by the width of the radiating finger and its spacing from the ground plane. The structure as a whole, i.e. the antenna and the associated conductive body, may be resonant in a number of different modes at different frequencies.

It has been found that if a dielectrically-loaded antenna such as those described in the above-mentioned patents is incorporated, together with a GPS receiver in a mobile telephone having a PIFA for transmitting and receiving terrestrial signals, severe breakthrough occurs between the PIFA and the GPS receiver when the mobile telephone transmitter is on. The degree of breakthrough depends on various factors including the frequency and bandwidth of the transmitted signal, the resonant characteristics of the PIFA, and the frequencies of the signals to be received by the dielectrically-loaded antenna and the associated receiver. In general, the breakthrough is such that there may be no useful signal reception via the dielectrically-loaded antenna when the mobile telephone transmitter is on.

SUMMARY OF THE INVENTION

According to a first aspect of the present invention, a mobile communication device comprises RF circuitry and an antenna assembly, wherein the RF circuitry has first and second RF signal ports and the antenna assembly includes a first antenna having an elongate radiator structure which is connected to the first port, and a second antenna having at least one radiating element and a balun which provides a balanced feed for the radiating element, the second antenna being located on the elongate radiator structure of the first antenna at a position spaced from the connection of the radiator structure to the first signal port, and wherein the elongate radiator structure of the first antenna acts as a feed path for the second antenna, which feed path extends along the radiator structure between the balun and the second signal port. The second antenna, which may be a quadrifilar or bifilar helical antenna, typically forms a distal end portion of the elongate radiator structure of the first antenna and is configured for services in which signals to be received are low level signals or spread-spectrum signals which are vulnerable to transmitter and system noise. Examples include signals transmitted from satellites, e.g. GPS signals, and spread-spectrum signals from terrestrial cellphone base stations. This antenna may be provided with a preamplifier included as part of the radiator structure of the first antenna, the preamplifier forming part of the feed path for the second antenna and being located on or adjacent the second antenna.

In the preferred embodiment of the invention, the first antenna is a telephone antenna for operation in the receiving and transmitting frequency bands of a designated cellular telephone service. In this embodiment, the radiator structure of the telephone antenna comprises a transmission line for feeding signals from the GPS antenna to the RF circuitry, the transmission line comprising a first conductor coupled to the second signal port and a second conductor parallel to and adjacent the first conductor and coupled to a node of the RF circuitry which forms a ground connection at least at an operating frequency of the telephone antenna. The elongate radiator structure of the GPS antenna may be a laminar assembly having a plurality of parallel elongate conductors insulated from each other. Thus, a tri-plate structure may be used, having three conductive layers insulated from each other by intermediate insulative layers, the two outer conductive layers comprising a pair of interconnected elongate conductors connected to the first signal port of the RF circuitry, and an inner elongate conductive track extending from the balun of the second antenna, or from the output of the preamplifier, and thence between the outer conductive layers to the second signal port of the RF circuitry.

Alternatively, the elongate radiator structure of the telephone antenna may be a coaxial cable or transmission line, the inner conductor of which is connected to the second signal port and the outer conductor of which is connected to the first signal port.

The balun of the second antenna typically comprises a conductive sleeve forming a cavity with a distally directed open end, the cavity being largely filled with a dielectric material having a relative dielectric constant greater than 5. The base of the cavity is formed by a proximal surface conductor which is electrically connected to the distal end portion of the telephone antenna radiator structure.

It will be understood that the invention is particularly but not exclusively applicable to a mobile communication device in which the first antenna is an inverted-F antenna. This antenna has at least one radiating finger the base of which is coupled by a feed connection element to the first signal port and by a shunt element to a ground connection spaced from the first signal port, the second antenna being at the end of the radiating finger. The second antenna may have a second radiating finger the base of which forms a common node with the base of the first radiating finger, the two radiating fingers having different resonant frequencies. On the end of the second radiating finger there is another dielectrically-loaded antenna with a balun, typically having a primary mode of resonance which is at a different frequency from the primary mode of resonance of the second antenna referred to above. This second dielectrically-loaded antenna has its own feed path conductor associated with the second radiating finger and coupling the second antenna to a third signal port of the RF circuitry. Preferably, both feed path conductors pass along the shunt element of the inverted-F antenna.

In preferred embodiments, the first antenna is a planar inverted-F antenna (PIFA), the or each radiating finger comprising a conductive strip located over and spaced from a ground plane conductor. In this case, each radiating finger of the PIFA, together with the feed connection element and the shunt element, are integrally formed as a multiple layer structure having an upper conductive layer, a lower conductive layer, and an intermediate layer which comprises the feed path track or tracks, the intermediate layer being insulated from the upper and lower conductive layers by insulating layers. The upper and lower layers are electrically interconnected at least at intervals along their lengths on opposite sides of the feed path track or tracks, e.g., by plated vias. The conductors of these upper and lower layers, at least where they form the elements of the first antenna (the PIFA), have the same shape and are in registry with each other.

According to another aspect of the invention, an antenna assembly for a dual-service radio communication device comprises a first single ended antenna having an elongate radiator structure which is connected to a first output node, and a second antenna having at least one radiating element and a balun which provides a balanced feed connection for the radiating element, the second antenna being located on the elongate radiator structure of the first antenna at a position spaced from the first output node, and wherein the elongate radiator structure of the first antenna acts as a feed path for the second antenna, which feed path extends along the radiator structure between the balun and a second output node.

Other aspects of the invention are set out in the claims hereinafter.

By locating the dielectrically-loaded antenna, including its balun, at the end of the elongate radiator structure of the first antenna, the ability of the first antenna to radiate energy at the primary operating frequency of the second antenna is curtailed, as will be described in more detail hereinafter, thereby reducing breakthrough from a transmitter coupled to the first antenna to receiving circuitry coupled to the second antenna.

In this specification, references to radiating elements and radiators are to be interpreted as including elements or structures which are used purely for receiving electromagnetic energy from their surroundings as well as those which transmit energy to the surroundings.

The invention will be described below by way of example with reference to the drawings.

DETAILED DESCRIPTION OF THE PREFERRED EMBODIMENTS OF THE INVENTION

Figure 1A:
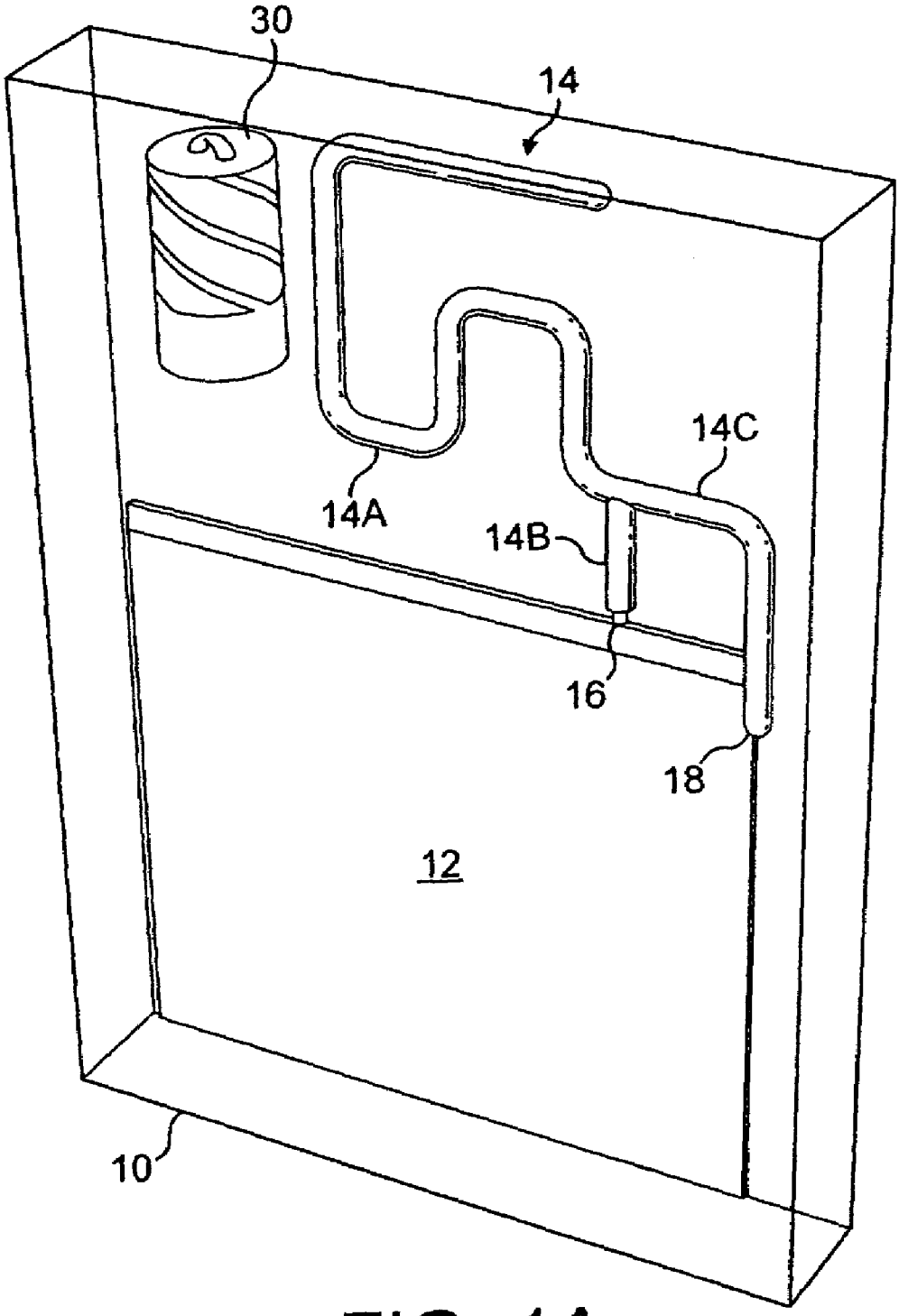
FIGS. 1A and 1B are, respectively, a diagrammatic representation of a handheld communication device having an inverted-F antenna and a dielectrically-loaded quadrifilar antenna for use with different wireless services and a graph showing how characteristics of the arrangement of FIG. 1A vary with frequency.

As stated above, it has been found that if a dielectrically-loaded helical antenna provided, e.g., for receiving GPS signals is incorporated in a mobile telephone having an inverted-F antenna for transmitting and receiving telephone signals, breakthrough occurs between the telephone transmitter, coupled to the inverted-F antenna, and a GPS receiver coupled to the dielectrically-loaded antenna. Such a combination of antennas is diagrammatically illustrated in FIG. 1A as part of a mobile communication device 10 having a main printed circuit board 12. For the purposes of this illustration, the inverted-F antenna 14 is composed of wire elements, specifically a resonant radiating branch element 14A the base of which is connected to a first radio frequency (RF) port 16 on the printed circuit board 12 by a feed connection element 14B. To provide an impedance match, the base of the radiating branch element 14A is also connected to a ground connection 18 on the board 12 by a shunt element 14C. The printed circuit board 12 provides a conducting body or ground plane which reflects waves induced in the antenna and, therefore, allows the antenna to resonate at a frequency according to its length.

Inverted-F antennas have a number of different forms. In particular, they may have one or more branch elements 14A which may be bent or folded into different shapes, according to the required resonant frequency or frequencies of the antenna and physical space constraints. The elements of the antenna may be wire elements, as shown in FIG. 1A, or they may be laminar in the sense of being formed from a conductive sheet or plate. In the latter case, the antennas are commonly referred to as planar inverted-F antennas or PIFAs. They all have the common characteristics of one or more fingers or branch elements connected to a feed connection element and an impedance matching shunt element which are, in turn, connected to spaced-apart signal and ground connections associated with RF transmitter and/or receiver circuitry.

Figure 1B:
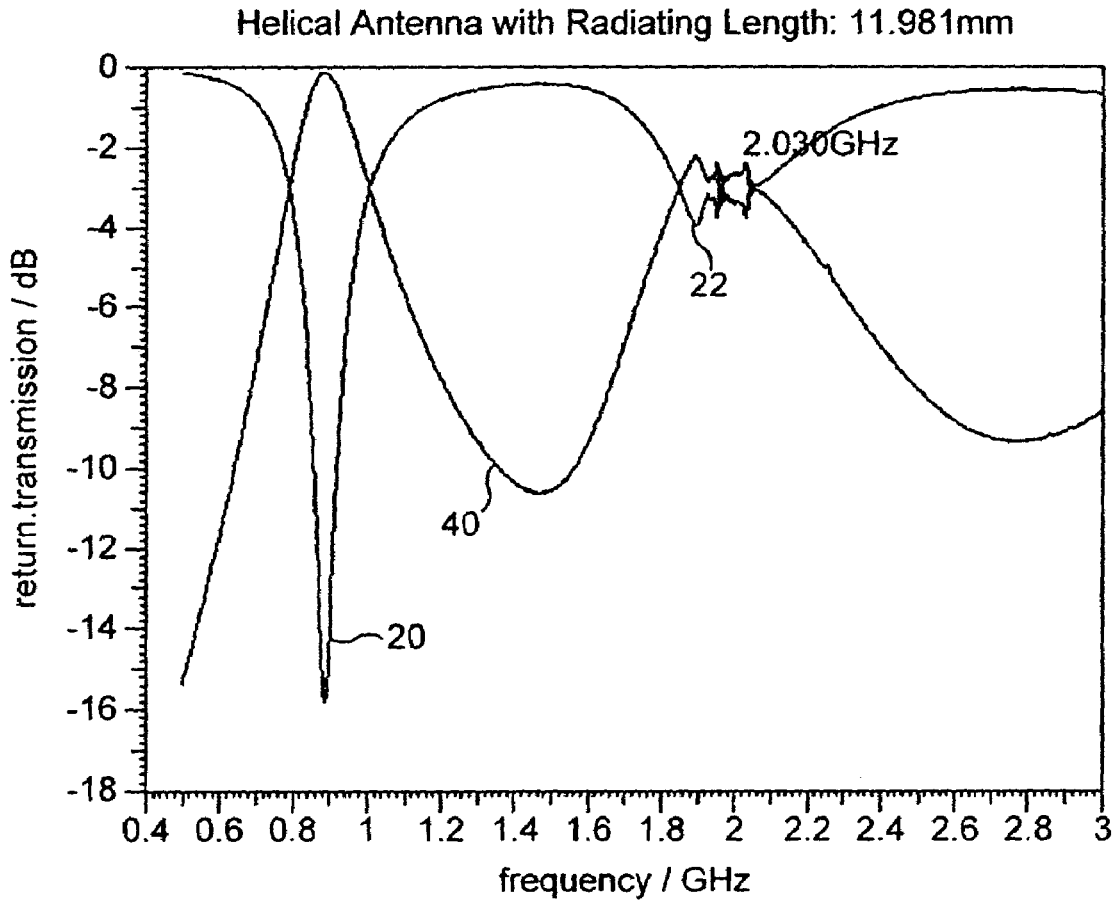

Typically, an inverted-F antenna has an insertion loss characteristic, as shown in FIG. 1B, having a fundamental resonance, represented by a first insertion loss notch 20, and one or more higher-order insertion loss notches such as notch 22 in the characteristic of FIG. 1B. It will be understood that if the antenna has more than one resonant branch element, the insertion loss characteristic has a larger number of notches.

The effect of introducing a second antenna for operation in a different frequency band from the frequency band of the inverted-F antenna is now considered. For the purposes of this illustration, the second antenna is a dielectrically-loaded quadrifilar helical antenna 30, as shown in FIG. 1A, for operation with circularly polarised electromagnetic waves as used, for instance, by satellite services. The antenna 30 has a cylindrical core made of a solid dielectric material having a relative dielectric constant typically in the region of 35 to 100, the material of the core filling the major part of the volume defined by its outer surfaces. Deposited on the outside of the core are four circumferentially spaced co-extensive helical radiating elements which extend from a feed connection on a distal face of the core to the rim of a plated conductive sleeve which encircles a proximal portion of the core. Extending through the core in an axial passage is a coaxial feeder the shield conductor of which is connected to the conductive sleeve by plating on a proximal end surface of the core so that the sleeve forms a balun operative at the intended operating frequency of the antenna. Although in FIG. 1A the antenna is shown without connection, in practice, the feeder would be connected to associated RF receiver circuitry (not shown) on the board 12.

The quadrifilar helix antenna 30 is particularly suited to receiving low-level circularly polarised signals over a wide solid angle radiation pattern. In this illustration, the dielectrically-loaded antenna 30 is selected to have a main resonance for circularly polarised electromagnetic radiation at a frequency in the region of one of the higher-order resonances of the inverted-F antenna 14. Typically, an antenna such as antenna 30 also has secondary resonances in the region of the main resonance. The effect of the antenna 30 on the insertion loss characteristic of the inverted-F antenna 14 is seen in FIG. 1B. At the higher-order inverted-F resonance, in this case occurring in the region of from 1.8 to 2.1 GHz, there is a transfer of energy from the inverted-F antenna 14 to the dielectrically-loaded antenna 30. The second trace 40 in FIG. 1B is the inverse of the insertion loss characteristic and effectively illustrates the gain of the inverted-F antenna at different frequencies. It will be seen that there is a small reduction in gain in the region of about 1.9 to 2.0 GHz.

The result of the transfer of energy to the dielectrically-loaded antenna is that, when a transmitter on the printed circuited board 12 operates at the main resonant frequency of the inverted-F antenna (here, about 900 MHz), out-of-band transmitted energy in the region of the higher-order resonance of the inverted-F antenna 14 is picked up by the dielectrically-loaded antenna 30 and interferes with the reception by the dielectrically-loaded antenna 30 of wanted signals at the frequency of its main resonance. In practice, the out-of-band energy from the transmitter is so great that, combined with the characteristics of the inverted-F antenna 14, energy breakthrough to the receiver circuitry associated with the antenna 30 prevents reception of the wanted signals. Operation of the receiver connected to the second antenna 30 is effectively confined, therefore, to periods when the mobile telephone transmitter is inactive. When the first antenna 14 is provided for CDMA telephone services in particular, this means that satellite signal reception is difficult.

Figure 2A:
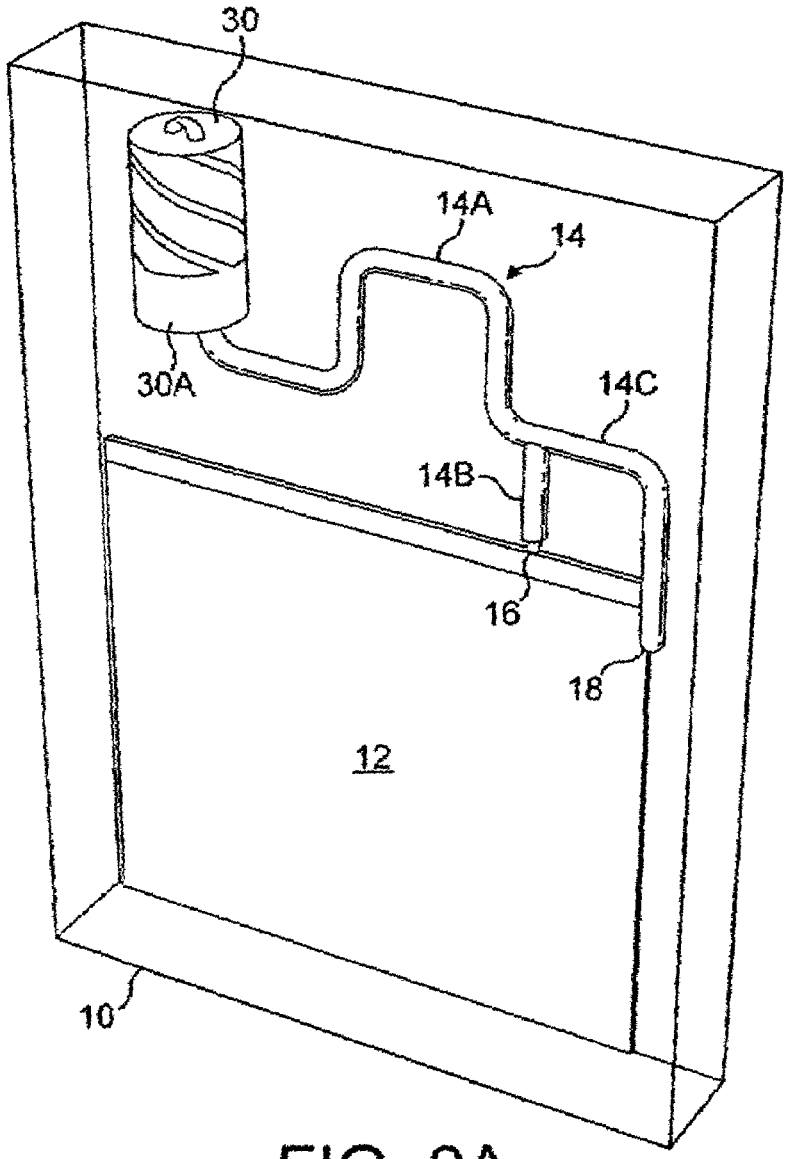
FIGS. 2A and 2B are, respectively, is a diagrammatic representation of a handheld communication device in accordance with the invention having an inverted-F antenna and a dielectrically-loaded quadrifilar antenna integrated with the inverted-F antenna and a graph showing how characteristics of the arrangement of FIG. 2A vary with frequency.

If the second antenna 30 is located, instead, on the end of the conductive branch element 14A of the inverted-F antenna 14, as shown in FIG. 2A, a significant improvement in performance results. In this instance, the branch element 14A and the matching element 14C are formed from a length of semi-rigid coaxial cable. The inner and outer conductors of this cable are connected to the inner and outer conductors of the coaxial feeder of the second antenna 30. It will be understood that this means that the outer conductor of the coaxial cable forming the branch and matching elements 14A, 14C of the inverted-F antenna 14 is connected to the balun sleeve 30A of the second antenna 30. The inner conductor of the coaxial cable terminates at a input port (not shown) of the RF circuitry on the printed circuit board 12, so that electromagnetic energy picked up by the second antenna 30 and fed to the balanced feed point at the top of its feeder at the distal end face of the antenna core can be fed to an appropriate receiver on the printed circuit board 12.

Figure 2B:
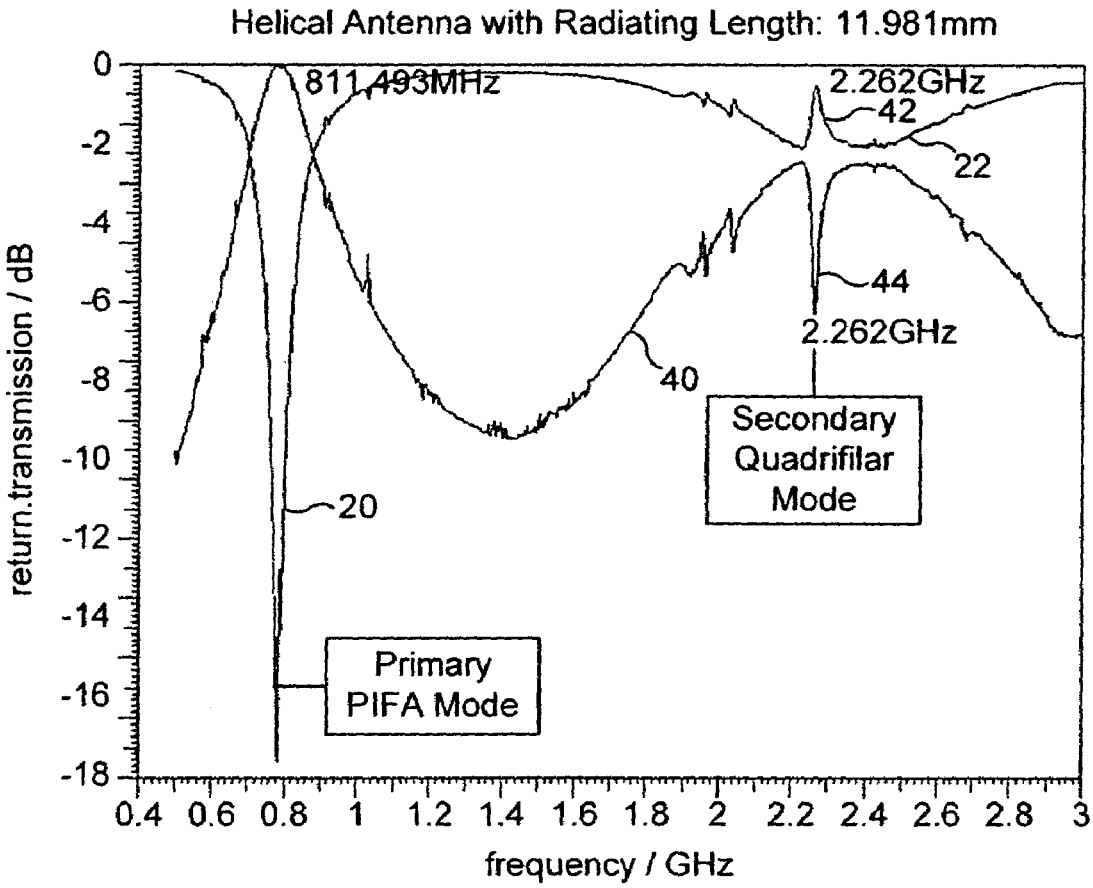

FIG. 2B is a graph showing insertion loss and gain characteristics produced by simulating the RF behaviour of the structure described above with reference to FIG. 2A. As before, the inverted-F antenna 14 has a primary resonance 20 and a secondary resonance 22 in the general region, in this case, of 2.1 to 2.5 GHz. However, at the frequency of the main quadrifilar resonance of the dielectrically-loaded antenna 30, the inverted-F antenna exhibits a pronounced insertion loss peak 42. The inverse gain characteristic 40 has a corresponding notch 44. As a result, the gain of the inverted-F antenna 14 at the operative resonant frequency of the dielectrically-loaded antenna 30 is substantially reduced. This has the effect of significantly reducing the energy transmitted at the relevant frequency when the telephone transmitter on printed circuit board 12 is active.

The effect which is evident from characteristics of this integrated antenna assembly may be explained by considering currents existing on the outside of the inverted-F antenna elements. Since the second antenna 30 is connected to the end of branching element 14A, it forms part of the radiator structure of the inverted-F antenna and, generally, currents fed to this structure via the feed connection element 14B pass along the branch element 14A and over the second antenna 30. The resonant length, therefore, of the inverted-F antenna 14 includes the second antenna 30 which, effectively, becomes part of the inverted-F antenna. It will be recalled that the inverted-F antenna 14 is a single-ended structure, resonance being achieved by reflection of radio frequency energy on the antenna elements by the ground plane represented by the printed circuit board 12. It follows that the frequencies of resonance of the inverted-F antenna 14 depend partly on the electrical length added to that of the branch element 14A by the antenna 30.

The conductive sleeve 30A acts as a quarter-wave trap at the required operating frequency of the dielectrically-loaded antenna 30, as described in the above-mentioned patents of the applicant. In this configuration, the sleeve 30A, being connected to the branch element 14A of the inverted-F antenna 14, not only provides a balanced feed for the helical elements of the antenna 30, but also presents a substantially infinite impedance at the distal rim of the sleeve to currents flowing over the outside of the sleeve from the shield conductor of the coaxial cable forming the branch element 14A. As a result, whereas with the configuration described above with reference to FIG. 1A the inverted-F antenna presented a good impedance match to the transmitter circuitry at the higher-order resonance of the antenna, in this case the antenna is substantially unmatched, as shown by the pronounced notch 44 in the gain characteristic of FIG. 2B. This is because the effective length of the branch element 14A is reduced as a result of the trap action of the conductive sleeve 30A on the antenna 30. In effect the PIFA 14 is prevented from resonating. Consequently, a comparatively small amount of energy is transmitted at the required operating frequency, near-field electromagnetic radiation is reduced, and reception of signals at that frequency by the dielectrically-loaded antenna 30 and its associated receiver is possible.

The frequencies of resonance of the inverted-F antenna 14 also depend on the proximity of the radio communication unit to conductive bodies such as the user's hand or head. This is because the antenna 14 is a single-ended antenna operating in conjunction with a ground plane of limited area. Consequently the positions of the insertion loss notches can vary widely in frequency making it difficult to predict the amount of energy which will be transmitted under differing conditions for any given antenna and transmitter configuration. In contrast, as a result of its dielectric loading, the resonances of the dielectrically-loaded antenna 30 are comparatively unaffected by such loading with the consequence that the insertion loss peak 42 remains at or very close to the required frequency and, consequently, the reduction in interfering transmitted noise is maintained.

Although an antenna assembly in accordance with the invention can be constructed using coaxial cable for elements of the inverted-F antenna, as described above, in practice, a planar inverted-F antenna (PIFA) construction is preferred to achieve the required bandwidth for terrestrial signals and for ease of manufacture. A PIFA embodiment will now be described with reference to FIG. 3.

Figure 3:
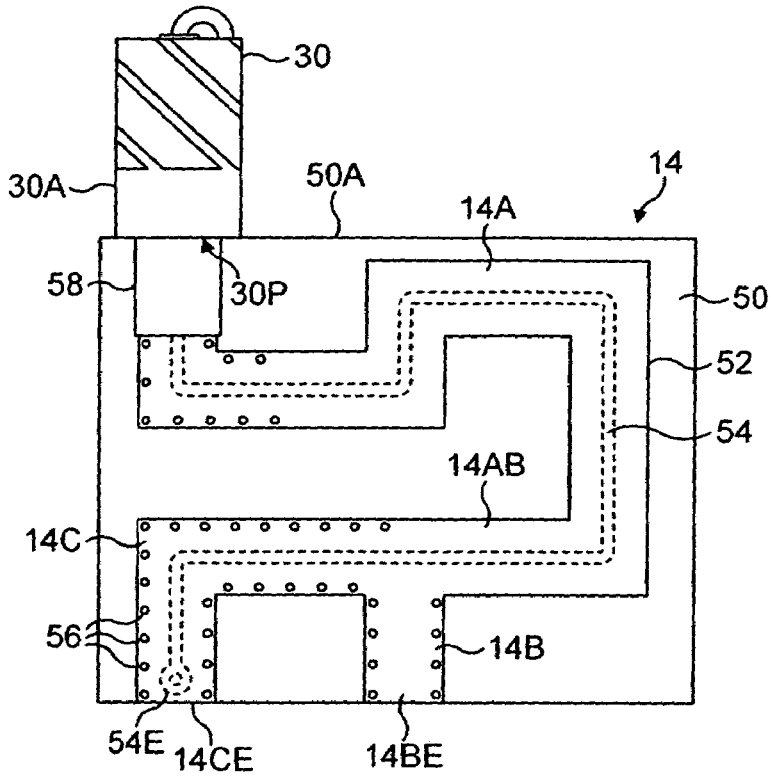
FIG. 3 is a diagrammatic plan view of an antenna assembly in accordance with the invention.

Referring to FIG. 3, a PIFA and dielectrically-loaded quadrifilar helix antenna combination has a tri-plate multiple layer printed circuit sub-assembly 50 having a first outer conductive layer 52 on one side, a second outer conductive layer (not visible in FIG. 3) on the other side, and an inner conductive layer visible as track 54 sandwiched between the two outer conductive layers and insulated from each of them by insulative layers. The pattern of the first outer conductive layer 52, which may be produced by conventional printed circuit techniques, is that of a PIFA. The pattern of the other outer conductive layer is identical to that of the first outer conductive layer 52 when viewed from above inasmuch as it forms tracks of the same dimensions as those of the conductive layer 52 and in registry with them. Peripheral vias 56 interconnect the edges of the tracks formed by the two outer conductive layers along the entire lengths of the tracks. Note that only some of the vias are shown in FIG. 3. The combination of the interconnected tracks formed by the two outer conductive layers is such as to form a planar inverted-F antenna with an elongate radiator structure including a conductive branch element 14A. At its base 14AB, the branch element 14A is integrally joined to a feed connection element 14B and a impedance-matching shunt element 14C, both of which extends to the edge of the multiple layer board 50.

The inner conductive layer 54 is patterned to form a track which runs along the branch element 14A and the shunt element 14C, approximately midway between the interconnecting vias 56.

In this way, the combination of the conductive track 54 and the wider tracks formed by the patterning of the two outer conductive layers constitute a transmission line extending along the length of the branch element 14A and the shunt element 14C. The track 54 ends in a pad 54E to which a connection may be made through an opening (not shown) in the outer conductive layer on the underside of the board 50. Mounted directly to an edge 50A of the board opposite to the edge 50B associated with the proximal ends 14BE, 14CE of the feed connection and shunt elements 14B, 14C is a dielectrically-loaded quadrifilar helix antenna 30, the central axis of which is parallel to the plane of the board 50. This antenna 30 extends outwardly from the edge 50A of the board 50 and outwardly away from the PIFA 14. As described above and in the above-mentioned prior patents, the quadrifilar helix antenna has an axial feed structure having a coaxial construction. In this embodiment, the feeder is connected to a preamplifier 58 which has an outer conductive screen connected to the end of the branch element 14A. The casing of amplifier 58 is also electrically connected to the conductive plating on the proximal end face 30P of the antenna 30 which, in turn, is electrically continuous with the conductive sleeve 30A on the outer cylindrical surface of the core. Accordingly, the preamplifier casing and the conductive elements on the outside of the core of the antenna 30 form a continuous conductive whole with the branch element 14A of the PIFA, as constituted by the patterned upper and lower layers of the board 50. In effect, therefore, the antenna 30 and its preamplifier 58 become an end portion of the PIFA radiator structure including its branch element 14A of the PIFA.

The inner conductor of the feeder of antenna 30 is connected to the input (not shown) of the preamplifier 58, the output (also not shown) of which is connected to the track 54 formed by the inner layer of the board 50. Accordingly, signals picked up by the antenna 30 are transmitted along the matched transmission line formed by the combination of the track 54 and the tracks formed by the patterning of the upper and lower outer layers, such signals being conducted away from the board adjacent the end 14CE of the shunt element 14C, as will be described below.

Figure 4:
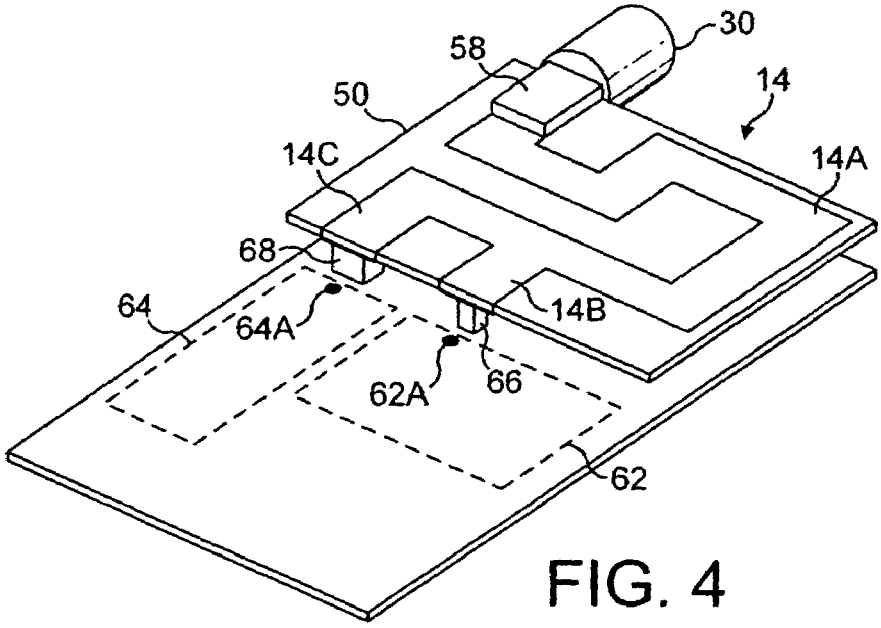
FIG. 4 is a perspective view showing the antenna assembly of FIG. 3 in juxtaposition with a communication device motherboard.

Referring now to FIG. 4, when it forms part of a mobile communication device, the antenna sub-assembly formed by the combination of the tri-plate board 50 and the dielectrically-loaded antenna 30 is mounted parallel to and spaced from a motherboard 60. This motherboard 60 has a plated conductive area in registry with the tri-plate board 50, over substantially the whole of its area, to provide a ground plane for the PIFA 14 formed by the patterned conductors of the tri-plate board 50.

The antenna sub-assembly is a three-terminal network in that it has a first terminal formed by the end 14BE of the feed connection element 14B, a second terminal formed by the end 54E of the inner track 54 which forms a feed path for signals from the antenna 30, and a third terminal formed by the end 14CE of the shunt element 14C of the PIFA. The motherboard 60 carries a transceiver 62 for telephone signals and a GPS receiver 64. Each has respective ports 62A and 64A for connection to the antenna sub-assembly. The first terminal of the sub-assembly, constituted by the end 14BE of the feed connection element 14B is connected to the port 62A of the transceiver 62 by a connection tab 66. The third terminal, constituted by the end 54E of the inner track 54 of the antenna sub-assembly is connected to the input port 64A of the GPS receiver 64 inside an enclosing shield 68 located between the tri-plate board 50 and the motherboard 60. This shield 68 provides a ground connection connecting the second terminal formed by the end 14CE of the shunt element 14C to the ground plane conductor of the motherboard 60. Thus, the second terminal forms a common ground associated with the two ports 62A, 64A.

Figure 5:
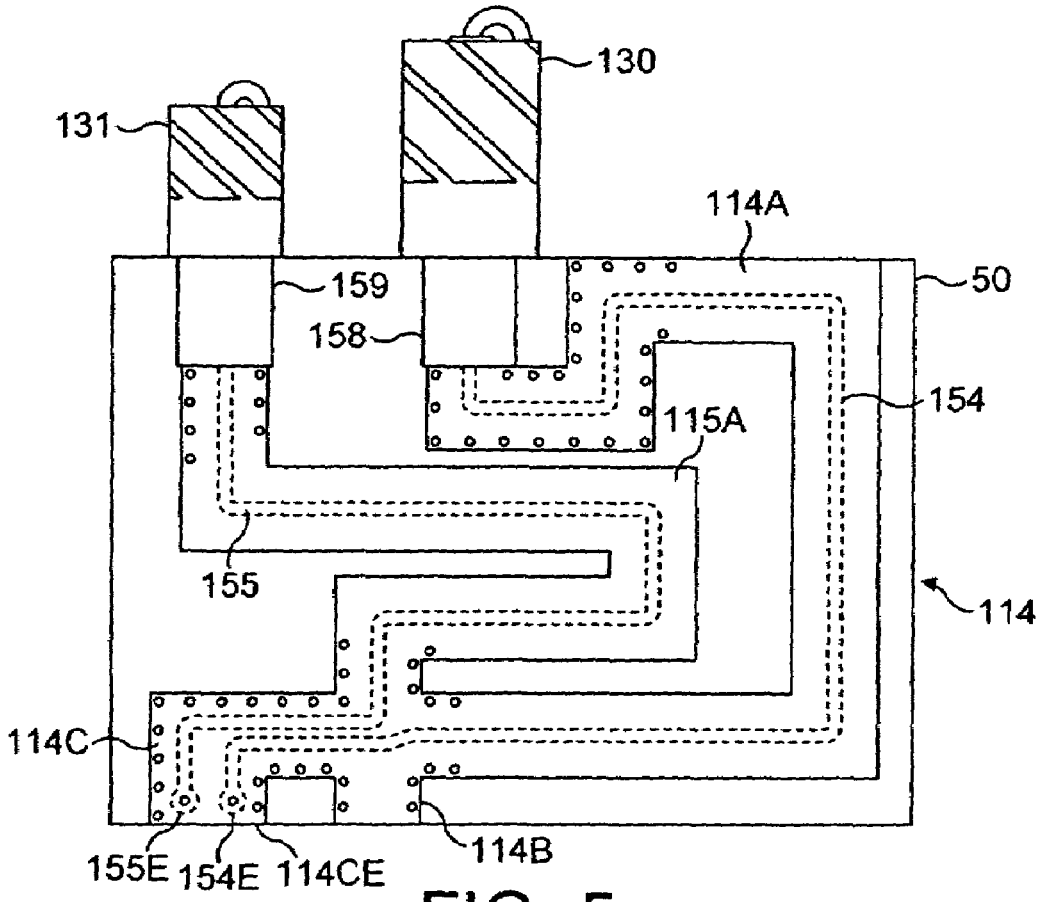
FIG. 5 is a diagrammatic plan view of a second antenna assembly in accordance with the invention.

Referring to FIG. 5, in an alternative embodiment, the PIFA has two radiator structures comprising respective branch elements 114A and 115A of different lengths. Each radiator structure has a respective dielectrically-loaded helical antenna 130, 131 with a respective preamplifier 158, 159 connected to the ends of the branch elements 114A, 115A, as shown. The base of each of the branch elements 114A, 115A is connected to a common feed connection element 114B and a common shunt element 114C. As in the embodiment described above with reference to FIG. 3, the elements of this two-branch PIFA 114 are formed by corresponding patterning of upper and lower outer conductive layers of a tri-plate board 50, the patterning for the PIFA elements being identical in both outer layers. The patterning forms tracks in registry with each other and interconnected along their entire edges by conductors bridging the thickness of the intervening layers (e.g., using series of vias). Each of the dielectrically-loaded antennas 130, 131 and the associated preamplifiers 158, 159 have a respective feed conductor 154, 155 formed as an inner conductive layer of the board 50. Each feed conductor 154, 155 extends along the respective branch element 114A, 115A between the two outer conductive layers and, thence, side-by-side along the shunt element 114C to respective terminals 154E, 155E at the end 114CE of the shunt element 114C.

In this example, antenna 130 is a quadrifilar helix antenna for receiving GPS satellite signals. Dielectrically-loaded antenna 131 is a bifilar helix antenna having paired helices for receiving terrestrial signals of, e.g., a 3G cellphone.

In the manner described above, each dielectrically-loaded antenna 130, 131 is isolated from the PIFA 114 at its respective operating frequency, any resonance of the respective PIFA branch being suppressed at that frequency.

It can be appreciated by those of ordinary skill in the art to which embodiments of the invention pertain that various substitutions, modifications, additions and/or rearrangements of the features of embodiments of the invention may be made without deviating from the spirit and/or scope of the underlying inventive concept. All the disclosed elements and features of each disclosed embodiment can be combined with, or substituted for, the disclosed elements and features of every other disclosed embodiment except where such elements or features are mutually exclusive. The spirit and/or scope of the underlying inventive concept as defined by the appended claims and their equivalents cover all such substitutions, modifications, additions and/or rearrangements.

The appended claims are not to be interpreted as including means-plus-function limitations, unless such a limitation is explicitly recited in a given claim using the phrase(s) "means for" and/or "step for." Subgeneric embodiments of the invention are delineated by the appended independent claims and their equivalents. Specific embodiments of the invention are differentiated by the appended dependent claims and their equivalents.

What is claimed is:

1. A mobile communication device comprising radio frequency (RF) circuitry and an antenna assembly, wherein the RF circuitry has first and second RE signal ports and the antenna assembly includes a first single-ended antenna having an elongate radiator structure which is connected to the first port, and a second antenna having at least one radiating element and a balun which provides a balanced feed for the radiating element, the second antenna forming a distal portion of the elongate radiator structure of the first antenna at a position spaced from the connection of the radiator structure to the first signal port, wherein the elongate radiator structure of the first antenna acts as a feed path for the second antenna, which feed path extends along the radiator structure between the balun and the second signal port, and wherein the second antenna has an electrically insulative core of a solid material having a relative dielectric constant greater than 5, the said at least one radiating element being disposed on or adjacent the outer surface of the core.

2. A device according to claim 1, wherein the balun is located on the core.

3. A device according to claim 1, wherein the radiator structure of the first antenna includes a pre-amplifier for the second antenna, the preamplifier forming part of the said feed path for the second antenna and being located on or adjacent the second antenna.

4. A device according to claim 1, wherein the radiator structure of the first antenna comprises a transmission line for feeding signals from the second antenna to the RF circuitry, the transmission line comprising a first conductor coupled to the second signal port and a second conductor parallel to and adjacent the first conductor and coupled to a node of the RF circuitry which forms a ground connection at an operating frequency of the second antenna.

5. A device according to claim 4, wherein the elongate radiator structure of the first antenna comprises a laminar assembly having a plurality of parallel elongate conductors insulated from each other.

6. A device according to claim 5, wherein the radiator structure of the first antenna is a tri-layer structure having three conductive layers insulated from each other by intermediate insulative layers, the outer conductive layers comprising a pair of interconnected elongate conductors connected to the said first signal port of the RF circuitry, and an inner elongate conductor located between the outer conductors and connected to said second signal port of the RF circuitry.

7. A device according to any claim 4, wherein the elongate radiator structure of the first antenna is a coaxial transmission line comprising an inner conductor connected to the second signal port and an outer conductor connected to the first signal port.

8. A device according to claim 1, wherein the elongate radiator structure is a coaxial cable having an inner conductor connected to the second signal port and a shield conductor connected to the first signal port.

9. A device according to claim 1, wherein the first antenna is an inverted-F antenna having at least one radiating finger, the base of which is coupled by a feed connection element to the first signal port and by a shunt element to a ground connection spaced from the first signal port, the second antenna being at the end of said at least one radiating finger.

10. A device according to claim 9, including at least a second radiating finger the base of which is joined to the feed connection element and the shunt element, the device further comprising a third antenna having at least one radiating element and a balun which provides a balanced feed connection for the radiating element, the third antenna being located at the end of the second radiating finger, which acts as a second feed path for the third antenna extending along the second radiating finger between the balun of the third antenna and a third signal port of the RF circuitry.

11. A device according to claim 10, wherein the second feed path extends through the shunt element to the third port.

12. A device according to claim 9, wherein the feed path for the second antenna extends through the shunt element to the second port.

13. A device according to any of claim 9, wherein the first antenna is a planar inverted-F antenna, said at least one radiating finger comprising a conductive strip located over and spaced from a ground plane conductor associated with the RF circuitry.

14. A device according to claim 13, wherein the feed connection element and the shunt element are planar conductor elements and the feed path for the second antenna comprises a conductive track which extends along said at least one radiating finger and the shunt element, parallel to the conductive elements forming the radiating finger and the shunt element.

15. A device according to claim 14, wherein said at least one radiating finger, the feed connection element and the shunt element are integrally formed together as a multiple layer structure having an upper conductive layer, a lower conductive layer and an intermediate layer comprising the feed path track, the track being insulated from the upper and lower conductive layers by insulating layers, and the upper and lower layers being interconnected at least at intervals along their length on opposite sides of the feed path track.

16. A device according to claim 15, wherein the upper and lower conductive layers are interconnected by plated vias.

17. A device according to claim 1, wherein the second antenna is adapted to receive circularly-polarised electromagnetic radiation.

18. A device according to claim 1, wherein the balun is adapted to isolate the second antenna from the first antenna at an operating frequency of the second antenna.

19. An antenna assembly for a dual-service radio communication device, comprising first and second output nodes, a first single-ended antenna having an elongate radiator structure which is connected to the first output node, and a second antenna having at least one radiating element and a balun which provides a balanced feed connection for the radiating element, the second antenna forming a distal end portion of the elongate radiator structure of the first antenna at a position spaced from the first output node, wherein the elongate radiator structure of the first antenna acts as a feed path for the second antenna, which feed path extends along the radiator structure between the balun and the second output node, and wherein the second antenna has an electrically insulative core of a solid material having a relative dielectric constant greater than 5, the said at least one radiating element being disposed on or adjacent the outer surface of the core.

20. An antenna assembly according to claim 19, wherein the first antenna is an inverted-F antenna having at least one radiating finger, the second antenna being located at the end of the radiating finger.

21. An antenna assembly according to claim 20, wherein the first antenna is a planar inverted-F antenna.

22. An antenna assembly according to claim 19, wherein the balun is on the core.

23. An antenna assembly according to claim 19, wherein the second antenna is adapted to receive circularly-polarised electromagnetic radiation.

24. An antenna assembly according to claim 19, wherein the balun is adapted to isolate the second antenna from the first antenna at an operating frequency of the second antenna.

25. An antenna assembly for a handheld communication unit, comprising:

first and second signal terminals and a grounding terminal;

an inverted-F antenna having a radiating branch element, a feed connection element connecting the branch element to the first signal terminal, and a grounding element connecting the branch element to the grounding terminal; and a dielectrically-loaded antenna having a three-dimensional antenna element structure and an integral balun configured to provide a balanced feed point for the antenna element structure;

wherein the dielectrically-loaded antenna is located on an end portion of the branch element with the balun electrically connected to the branch element; and wherein the assembly further comprises a feed path for the dielectrically-loaded antenna which extends along the branch element and the grounding element of the inverted-F antenna to the second signal terminal, the second signal terminal being adjacent said grounding terminal.

26. A multiple service mobile radio communication device comprising: radio frequency (RF) circuitry capable of operating in a plurality of frequency bands simultaneously, the circuitry including a first signal port for signals in at least a first band, a second signal port for signals in at least a second band, and a common ground for signals in the first and second band; and an antenna assembly in the form of a multiple terminal network connected to the RF circuitry and having first, second and third terminals, wherein the antenna assembly comprises (a) an inverted-F antenna having an elongate conductive branch element, a conductive feed connection element and a conductive grounding element, said branch element having a base that is connected to said first terminal by said conductive feed connection element and to said second terminal by said conductive grounding element; and (b) a dielectrically-loaded antenna having a feeder, a core having a core outer surface and being made of a solid material the relative dielectric constant of which is greater than 5, at least one radiating element on or adjacent the core outer surface, and a balun on the core outer surface and connecting the radiating element to said feeder; and wherein the dielectrically-loaded antenna is located at a distal end of the branch element of the inverted-F antenna, the antenna assembly further comprising a feed path which extends from the feeder of the dielectrically-loaded antenna along the branch element and the grounding element of the inverted-F antenna to said third terminal, said first and third terminals being connected to the first and second ports respectively and said second terminal being connected to the common ground of the RF circuitry.

27. An antenna assembly for a multiple service radio communication device, wherein the assembly is in the form of a multiple terminal network having first, second and third terminals and comprises (a) an inverted-F antenna having an elongate conductive branch element, a conductive feed connection element and a conductive grounding element, said branch element being a base that is connected to said first terminal by said conductive feed connection element and to said second terminal by said conductive grounding element; and (b) a dielectrically-loaded antenna having a feeder, a core having a core outer surface and being made of a solid material the relative dielectric constant of which is greater than 5, at least one radiating element on or adjacent the core outer surface, and a balun on the core outer surface and connecting the radiating element to said feeder; and wherein the dielectrically-loaded antenna is located at a distal end of the branch element of the inverted-F antenna, the antenna assembly further comprising a feed path which extends from the feeder of the dielectrically-loaded antenna along the branch element and the grounding element of the inverted-F antenna to said third terminal.

28. An assembly according to claim 27, wherein:

the feeder has first and second conductors that are coupled respectively to said feed path and to said conductive branch element of the inverted-F antenna.

the balun is a conductive balun sleeve connected to the second conductor of the feeder and having a sleeve rim; and the dielectrically-loaded antenna comprises a backfire helical antenna having a plurality of coextensive helical antenna elements extending from the first conductor of the feeder to the rim of the conductive balun sleeve.

* * * * *

UNITED STATES PATENT AND TRADEMARK OFFICE

CERTIFICATE OF CORRECTION

PATENT NO. : 7,408,515 B2
APPLICATION NO. : 11/263643
DATED : August 5, 2008
INVENTOR(S) : Oliver Paul Leisten It is certified that error appears in the above-identified patent and that said Letters Patent is hereby corrected as shown below:

In claim 1, column 9, line 60, after the phrase "has first and second", replace "RE" with --RF--.

Signed and Sealed this

Twenty-fifth Day of November, 2008

JON W. DUDAS
*Director of the United States Patent and Trademark Office*